US011371816B2

(12) United States Patent
Rose et al.

(10) Patent No.: US 11,371,816 B2
(45) Date of Patent: Jun. 28, 2022

(54) SMOKE DEVICE

(71) Applicant: 3rd Light IP Holdings LLC, Pahrump, NV (US)

(72) Inventors: James Rose, Reading (GB); John Perriam, Reading (GB)

(73) Assignee: 3RD LIGHT IP HOLDINGS LLC, Pahrump, NV (US)

( * ) Notice: Subject to any disclaimer, the term of this patent is extended or adjusted under 35 U.S.C. 154(b) by 0 days.

(21) Appl. No.: 17/227,411

(22) Filed: Apr. 12, 2021

(65) Prior Publication Data

US 2022/0011081 A1 Jan. 13, 2022

Related U.S. Application Data

(63) Continuation-in-part of application No. 16/925,356, filed on Jul. 10, 2020, now Pat. No. 11,009,324.

(51) Int. Cl.
*F42B 12/48* (2006.01)

(52) U.S. Cl.
CPC ..... *F42B 12/48* (2013.01)

(58) Field of Classification Search
CPC ..... F42B 12/02; F42B 12/36; F42B 12/40; F42B 12/46; F42B 12/48; F42B 12/50
See application file for complete search history.

(56) References Cited

U.S. PATENT DOCUMENTS 2,546,964 A * 4/1951 Blackford ..... F41H 9/08 422/305
2,959,127 A * 11/1960 Weinert ..... F42B 12/50 102/368
3,707,918 A * 1/1973 Dunfee ..... F42B 12/50 102/370
7,317,662 B2 * 1/2008 Unsworth ..... A63H 5/04 367/144
7,325,495 B1 * 2/2008 Giandomenico ..... F41H 9/10 102/368
7,762,585 B2 * 7/2010 Patterson ..... B60R 21/26 280/740

(Continued)

FOREIGN PATENT DOCUMENTS

GB 803618 A * 10/1958 ..... F41H 9/08
GB 1139761 A * 1/1969 ..... F42B 12/50
WO WO-2006096918 A1 * 9/2006 ..... C06D 3/00

*Primary Examiner* — Benjamin P Lee
(74) *Attorney, Agent, or Firm* — Bayramoglu Law Offices LLC

(57) ABSTRACT

A smoke device comprises a container, a base/base plate, a plate having at least one exit hole, a blend of chemicals contained in the container and a mechanical means by which generated smoke is prevented from directly exiting through the at least one exit hole without first being redirected in one or more directions. The mechanical means by which generated smoke is prevented from directly exiting through the at least one exit hole without first being redirected in one or more directions may include a plurality of baffles which have at least one hole therein and a plurality of chambers formed by the plurality of baffles. Each baffle has holes offset from holes in an adjacent baffle. The plurality of baffles may be spaced apart by using support posts and/or can be supported by support rings and/or can be supported by support pins and/or can be supported by support brackets.

16 Claims, 24 Drawing Sheets

(56) References Cited

U.S. PATENT DOCUMENTS

| | | | | |
|---|---|---|---|---|
| 7,814,838 | B2 * | 10/2010 | McCormick | C06D 5/06<br>102/530 |
| 9,198,508 | B1 * | 12/2015 | Kufel | A47B 47/024 |
| 2006/0233050 | A1 * | 10/2006 | Unsworth | A63H 37/00<br>367/144 |
| 2014/0191057 | A1 * | 7/2014 | Eames | B01F 5/0451<br>239/8 |
| 2015/0027334 | A1 * | 1/2015 | Kireev | F42B 12/40<br>102/439 |
| 2018/0259301 | A1 * | 9/2018 | Mimura | F42B 12/48 |

* cited by examiner

SMOKE DEVICE

CROSS-REFERENCE TO RELATED APPLICATIONS

This application is a continuation in part of U.S. patent application Ser. No. 16/925,356, filed on Jul. 10, 2020, the entire contents of which are incorporated herein by reference.

TECHNICAL FIELD

The present disclosure relates to a smoke device. More specifically, the present disclosure relates to a smoke device which has the ability to release different colors of smoke therefrom in a safe manner.

BACKGROUND

A smoke device may also be known in the art as a smoke grenade or a smoke bomb. A prior art smoke device comprises a container that contains a blend of chemicals. Once the blend of chemicals is ignited, the blend of chemicals burns to produce heat, gas and colored smoke which is forced out of the container and can be seen by onlookers.

Colored smoke has been around for many years and has been used commercially in fireworks, theatrical effects and film. Also, colored smoke has been used for military purposes such as screening or signaling smoke.

As shown in the prior art devices of FIG. 1, FIG. 2, FIG. 3, FIG. 4 and FIG. 5 the blend of chemicals is installed within the container. The container has a single exit point or multiple exit ports for the smoke to vent through. The exit point(s) is/are usually a small aperture which enables the smoke to build in pressure and exit the container at a higher pressure and with greater projection. The container is formed of only a single space between the bottom of the container and the exit hole.

Furthermore, in the prior art, there are a variety of ignition methods such as a safety fuse (i.e. lit from an external source), an electric igniter/electric match, friction or strike (i.e. like a match) and pull pin/percussion or fly-off lever (i.e. mainly military) as shown in FIGS. 6-10.

The problem with existing designs of the prior art is that during the burning of the blend of chemicals, the flames, the hot gas and the hot ash are also produced and projected out of the exit hole in addition to the colored smoke. The heat, flame and hot ash can cause fires when the prior art devices are placed on flammable materials such as dried grass, leaves, paper or furniture and also cause burns and injury to a user and people in the nearby vicinity if the prior art devices are not used correctly and if the correct personal protective equipment is not worn.

Thus, there is a present need for a safe smoke device. The present disclosure has solved the above problems with the below disclosed safe smoke device. The smoke device is safer to use by vastly reducing sparks, hot ash and flames from exiting the device and preventing fire and injury. Another disclosed advantage of the present disclosed smoke device is that as the generated smoke passes through baffles or chambers and cools more than in devices with a single chamber or no chamber. The cooler smoke gives improved color and less bleaching resulting in richer colors.

SUMMARY

The present disclosure is a smoke device which has the ability to release different colors of smoke therefrom in a safe manner.

The smoke device includes a container, a base/base plate, a plate having at least one exit hole, a blend of chemicals and/or a smoke composition contained in the container and a mechanical means by which generated smoke is prevented from directly exiting through the at least one exit hole without first being redirected in one or more directions. The plate acts to reduce the diameter of the container at the exit hole(s). This can be done in a variety of methods and with a variety of materials. A plug or a plug style choke can replace the plate of the smoke device. The exit hole(s) in the plate can be called a choke. Thus, the container is said to be choked. One example of the blend of chemicals and/or a smoke composition in the container is Potassium Nitrate (an oxidizer), Sulphur (a fuel), Colored Smoke Dye and Lactose. Another example of the blend of chemicals and/or a smoke composition in the container is Potassium Chlorate, Lactose and Colored Smoke Dye.

The mechanical means by which generated smoke is prevented from directly exiting through the at least one exit hole without first being redirected in one or more directions may include a plurality of baffles which have at least one hole therein and a plurality of chambers formed by the plurality of baffles.

The container may be made from cardboard, plastic, metal, alloy or a composite material.

The base/base plate is located in the bottom of the container. The base/base plate seals the bottom of the contain such that the blend of chemicals contained in the container does not leak out of the container. The sealing of the base/base plate to the container may be by means of a glue, a sealant, an epoxy, a groove and O-ring seal, a friction fit seal or any equivalent sealing apparatus or by welding, soldering, riveting, securing screws through holes formed in the container and the base/base plate or other equivalent attachment methods. The base/base plate may be made from cardboard, plastic, metal, alloy or a composite material. The base/base plate may be formed from a single part/piece or from multiple parts/pieces.

The plate having at least one exit hole therein is attached to a top of the container. The plate is attached to the top of the container by using a glue, a sealant, an epoxy, a groove and O-ring seal, a friction fit seal or equivalent attachment apparatus or by welding, soldering, riveting, securing screws through holes formed in the container and the plate or other equivalent attachment methods. There is at least one exit hole in the plate which may be formed in the geometric center of the plate or may be off set from the geometric center of the plate. Moreover, there may be a plurality of holes in the plate. The holes may be circular, square or any other geometric or polygonal shape. The range of the hole sizes is dependent on the size (diameter) of the smoke device and the holes range between 5 mm-20 mm but maybe smaller or bigger depending on the size of the smoke device. The plate may be made from cardboard, plastic, metal, alloy or a composite material.

The smoke device may also include support posts and/or support rings and/or support pins and/or support brackets.

The container of the smoke device has a plurality of chambers, a minimum of two chambers. The plurality of chambers is formed by the plurality of baffles. The distance between adjacent chambers may be the same for all chambers or there may be difference distances between adjacent chambers. The plurality of baffles may be spaced apart by using support posts and/or the plurality of baffles can be supported/held in place using support ring(s) and/or the plurality of baffles can be supported/held in place using support pin(s) and/or the plurality of baffles can be supported/held in place by support bracket(s) and the top most baffle in the smoke device may be attached to the plate.

The support ring has an outside wall that is the shape of the inside wall of the container. The support ring has a height and a wall thickness resulting in the support ring being hollow (i.e. the support ring has a hollow interior). The support ring can be made of a variety of materials such as cardboard, metal plastic, wood clay or composite material and may be made from the same or different material than the container and/or one or all baffles.

The support ring may or may not be glued to the inside all of the container and may or may not be glued to the baffles. The support ring may or may not be held in position by using pins, staples, rivets or equivalent fastening apparatus or elements that protrude through the outer wall of the container and into the support ring. The baffle and supporting ring may or may not be constructed in one piece from the same material and may or may not be glued or held in position with pins, staples, or rivets or equivalent fastening apparatus or elements.

The support pin(s) are small/short lengths of a material that protrudes into or is stuck to the wall of the container. Support pins can range in diameter and length depending on the overall size of the smoke device, but typical values are 1-5 mm in diameter and 5-30 mm in length. The support pin(s) can be made from a variety of materials such as cardboard, metal plastic, wood, clay or composite material and may be made from the same or different material than the container and/or one or all baffles. The support pin may or may not be glued to the baffles or may or may not be inserted into the baffle to hold or in position.

The support bracket can be a variety of shapes and sizes including part of the support ring that is either glued to the inside wall of the container or has a protrusion that protrudes into the wall of the container. The baffles may or may not be glued to the support bracket.

Each of the baffles has one or more holes therein. The range of the hole sizes in the baffles is dependent on the size (diameter) of the smoke device and the holes in the baffles range between 5 mm-20 mm but maybe smaller or bigger depending on the size of the smoke device. The plurality of baffles is placed in a staggered formation such that the hole(s) formed in each baffle is offset from the hole(s) in an adjacent/neighboring baffle. The hole(s) in each of the baffles are offset with regards to each neighboring baffle. The hole(s) in each baffle may be circular, square or any other geometric or polygonal shape. The hole(s) in each baffle may be formed in the geometric center of the baffle or may be off set from the geometric center of the baffle. Moreover, the holes in each baffle and/or each adjacent/neighboring baffle may have a different size or a same size in order to solve the problem of reducing sparks, hot ash and flames from exiting the smoke device, which prevents fire and injury and also cools the generated smoke thereby providing improved smoke color and less bleaching resulting in richer colors. The plurality of baffles and the plurality of chambers having offset holes serve to dramatically reduce and in some cases eliminate the hot ash, sparks and flame being emitted from the exit hole(s) and significantly reduces the chance of causing fires or injury to people. Thus, the disclosed smoke device is far safer than the existing prior art designs. Also, the plurality of baffles may include one or more spiral baffle(s) in which the smoke moves up a spiral shaped tube or chute to an exit point of the spiral baffle. Each of the baffles may be made from cardboard, plastic, metal, alloy or a composite material. Furthermore, each of the baffles may be made from a different material or some baffles may be made from the same material while other baffles are made from a different material in order to increase the cooling of the smoke and improve the smoke color and less bleaching resulting in richer colors. For example, the two lower most baffles in the container are made from metal or alloy and the upper most baffle in the container is made from cardboard, plastic or a composite material. Another example may include the upper most baffle may be made from a metal or alloy, the bottom most baffle may be made from plastic or a composite material and one or two additional baffles are made from cardboard. The above disclosed examples are only a few specific disclosed examples but different examples of different baffles comprised of different materials which solve the problem of reducing sparks, hot ash and flames from exiting the smoke device, prevents fire and injury and also cooling the generated smoke and improving the smoke color and less bleaching resulting in richer colors are also part of the disclosure of this smoking device. Each of the baffles may be formed from a single part/piece or from multiple parts/pieces. Each of the baffles may or may not be attached or secured to an inner surface of the container by using a glue, a sealant, an epoxy, a groove and O-ring seal, a friction fit seal or equivalent attachment apparatus or by welding, soldering, riveting, securing screws through holes formed in the container and the baffles or other equivalent attachment methods. Moreover, each of the baffles are position above the top level of the blend of chemicals which is contained in the container.

The smoke device and design incorporating the plurality of baffles and multiple chambers may function with and by all existing ignition devices and methods such as a safety fuse, an electric igniter/electric match, friction or strike (i.e. like a match), a pull pin/percussion or fly-off lever. The range of distances between each of the baffles is dependent on the size (length and diameter) of the smoke device and the distance between each of the baffles can range between 10 mm and 100 mm but could be smaller or bigger depending on the size of the smoke device. The types of ignition come from the ways in which heat can be generated such as heat from an external source, friction, electrical and impact (percussion). Within these general groups the actual mechanism of generating the heat can vary widely and many involve more than one type connected together known as a pyrotechnic train.

The device is mainly for civilian use but may also be applied to military and law enforcement training devices. The smoke device is not a military specific product. The smoke device reduces and/or eliminates sparks, hot ash and flames from exiting the smoke device and thus is safer than existing prior art products. Therefore, the smoke device is safer to use because the smoke device vastly reduces sparks, hot ash and flames from exiting the smoke device, prevents fire and injury and the generated smoke passing through the baffles and/or chambers cools more than other prior art devices with a single chamber or no chamber. Thus, this cooler generated smoke gives an improved color and less bleaching resulting in richer colors.

BRIEF DESCRIPTION OF THE DRAWINGS

In order to more clearly illustrate the embodiments of the present disclosure, a brief description of the drawings is given below. The following drawings are only illustrative of some of the embodiments of the present disclosure and for a person of ordinary skill in the art, other drawings or embodiments may be obtained from these drawings without an inventive effort.

DETAILED DESCRIPTION

Figure 1:
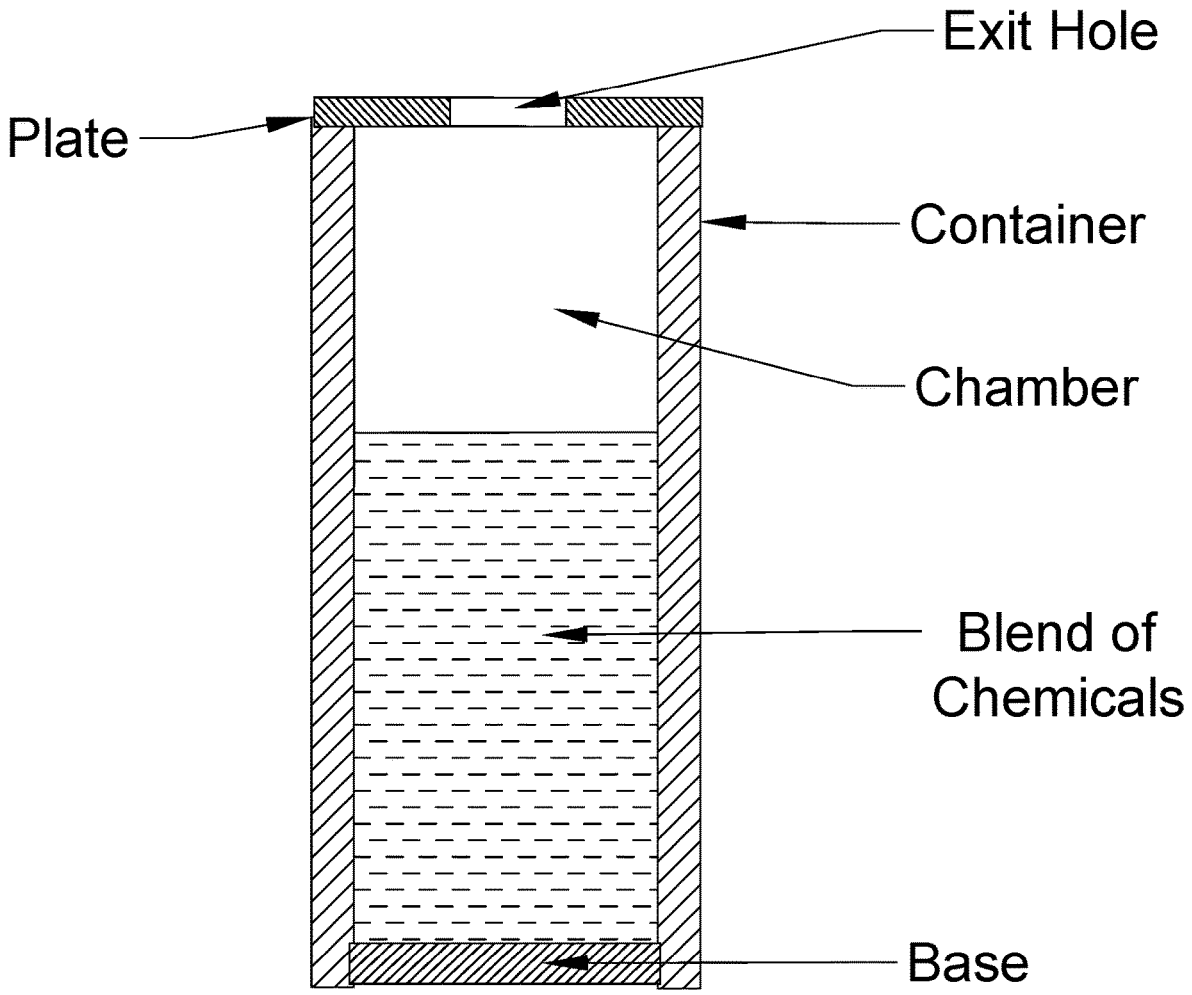
FIG. 1 (Prior Art)
FIG. 1 is an embodiment of a prior art smoke device.
Figure 2:
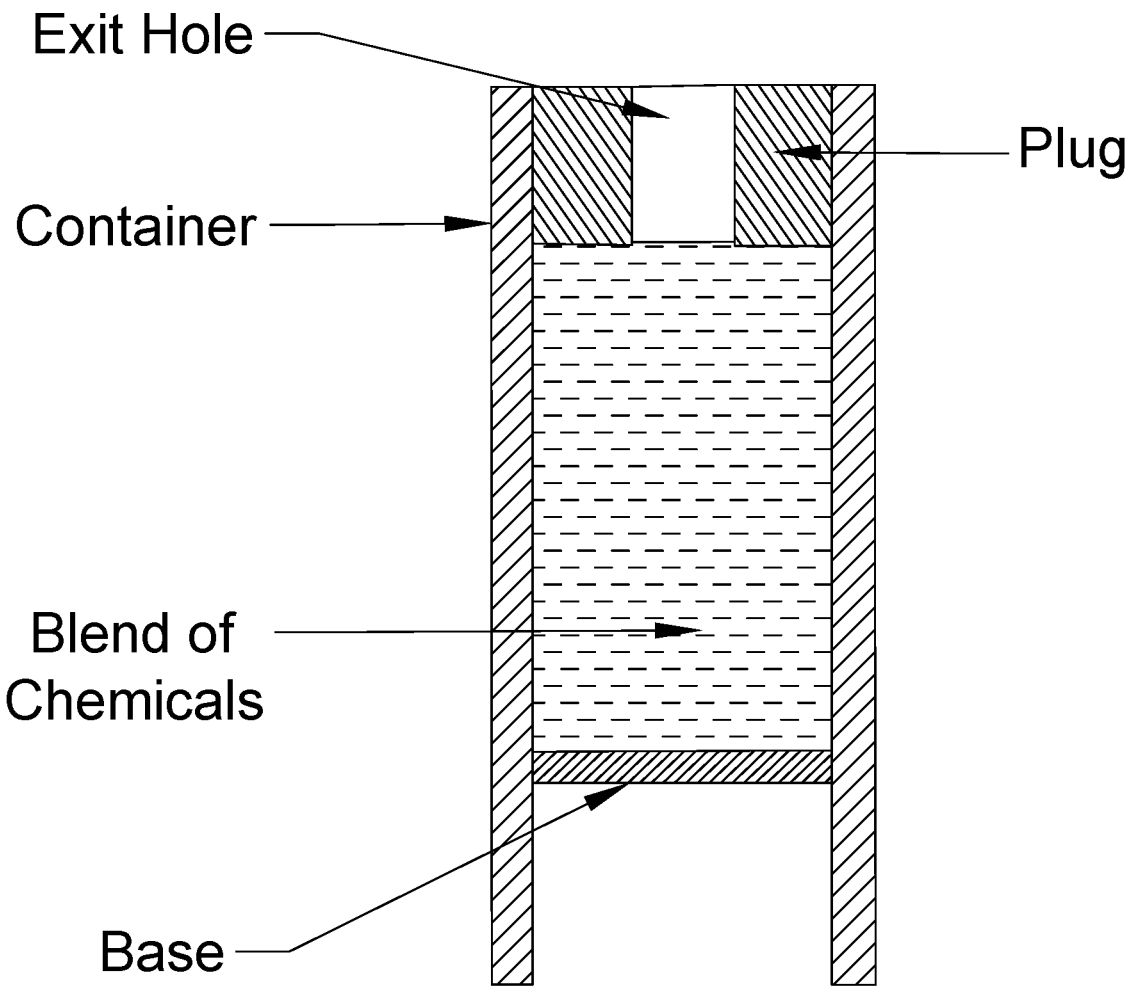
FIG. 2 (Prior Art)
FIG. 2 is another embodiment of a prior art smoke device.
Figure 3:
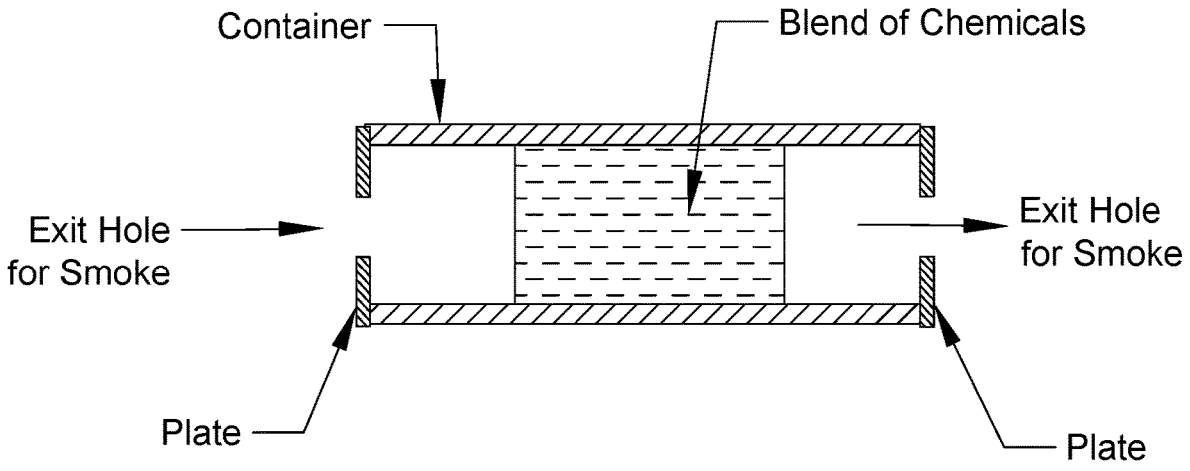
FIG. 3 (Prior Art)
FIG. 3 is another embodiment of a prior art smoke device.
Figure 4:
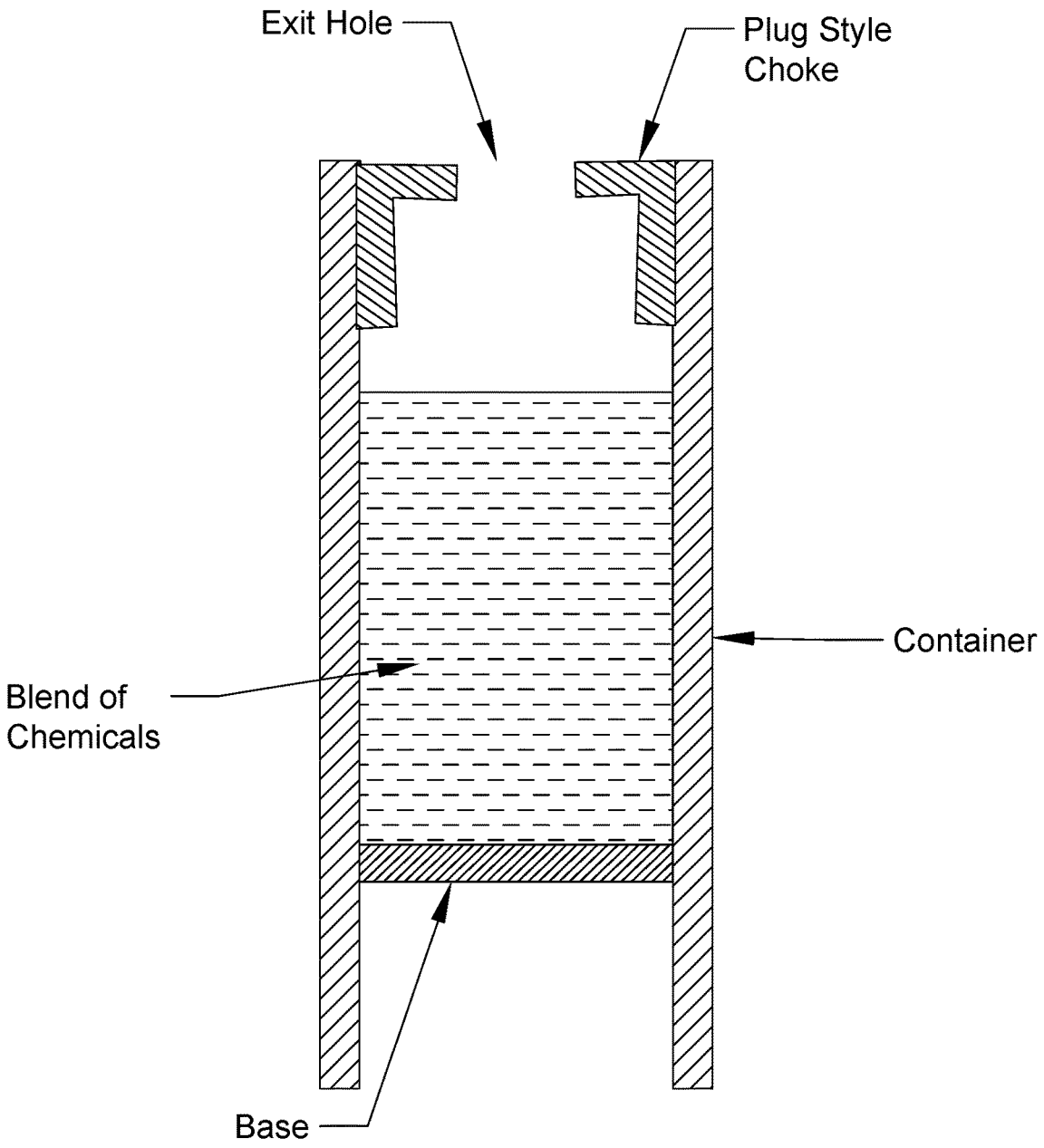
FIG. 4 (Prior Art)
FIG. 4 is another embodiment of a prior art smoke device.
Figure 5:
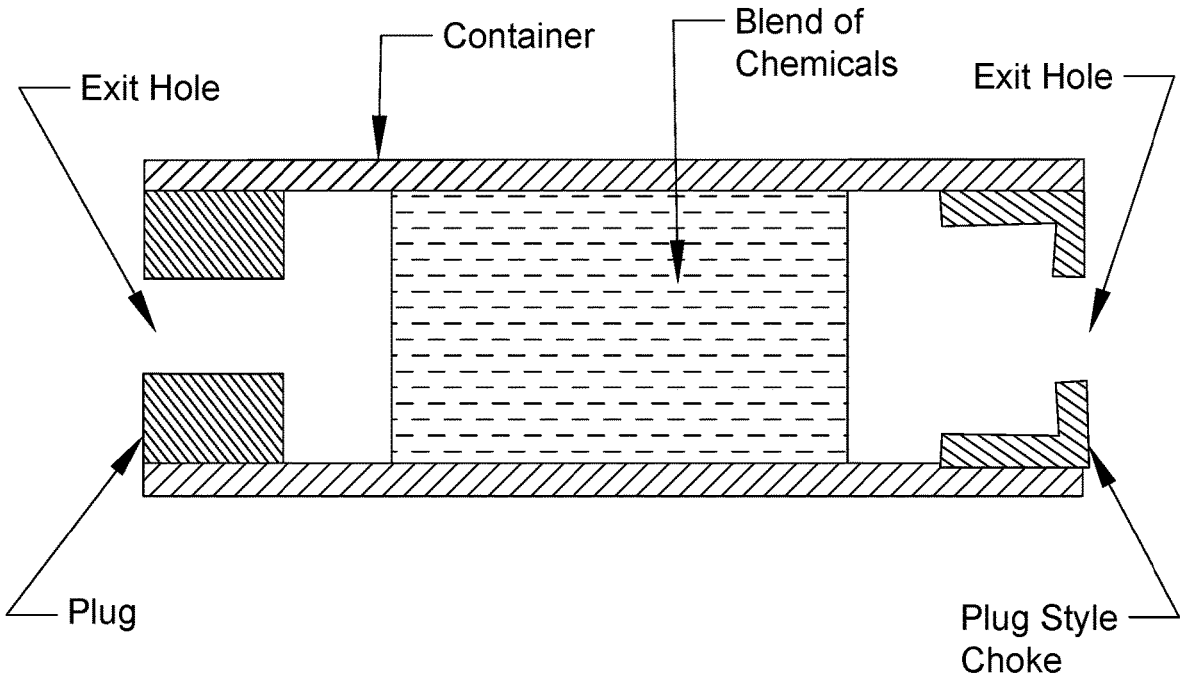
FIG. 5 (Prior Art)
FIG. 5 is another embodiment of a prior art smoke device.
Figure 6:
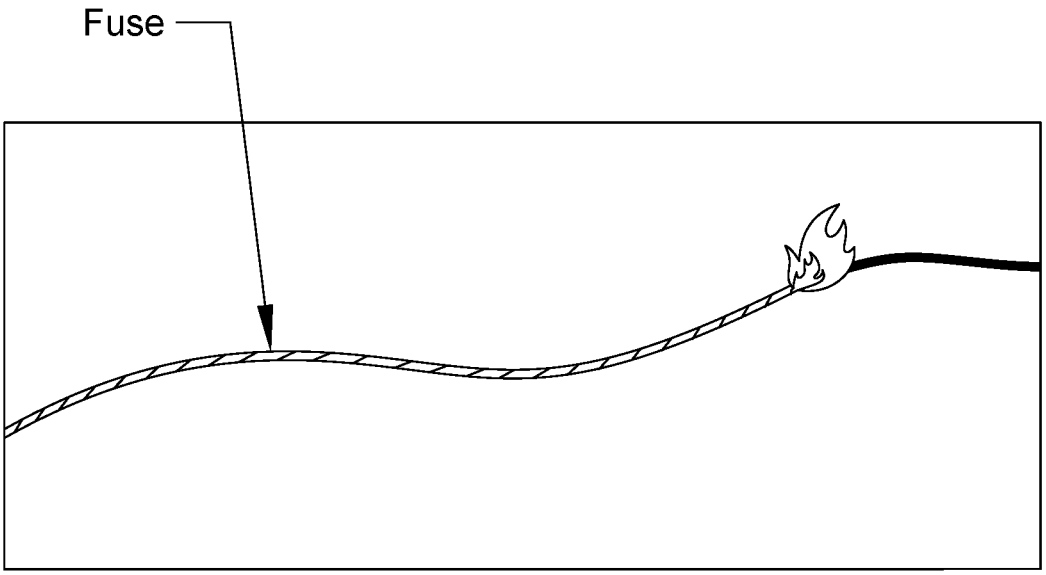
FIG. 6 (Prior Art)
FIG. 6 is a prior art fuse which can be used in the smoke device of the present invention.
Figure 7:
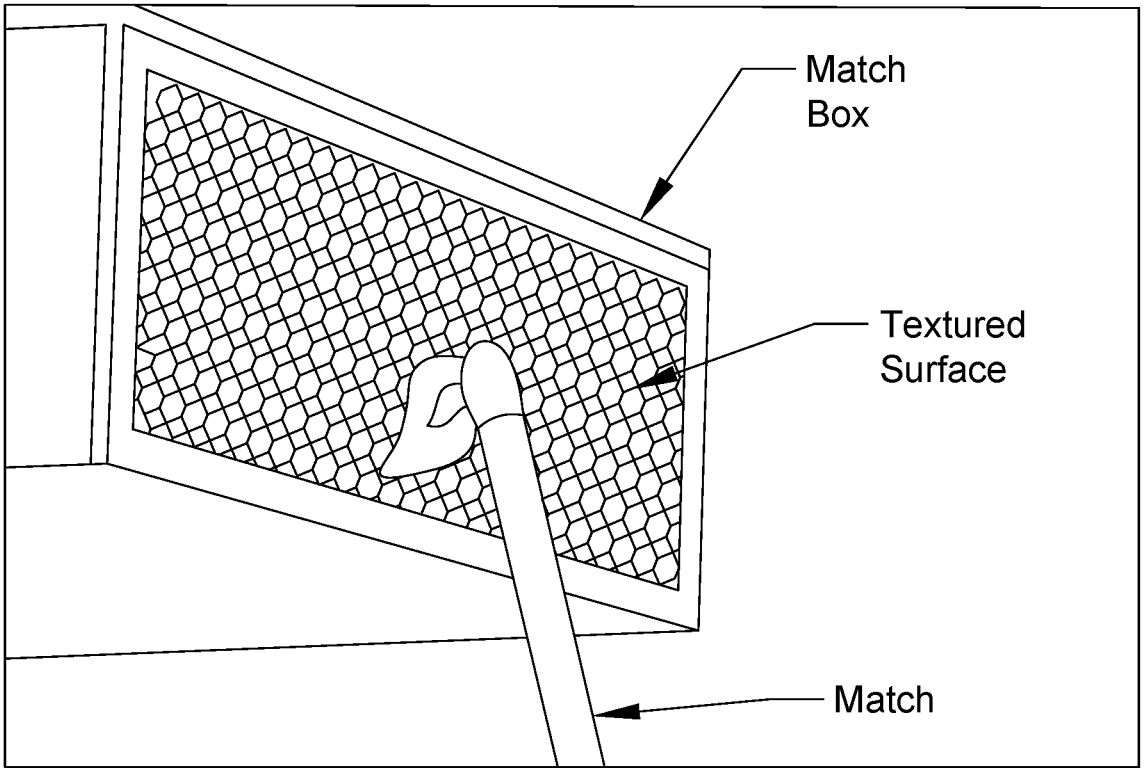
FIG. 7 (Prior Art)
FIG. 7 is a prior art match friction ignition source which can be used in the smoke device of the present invention.
Figure 8:
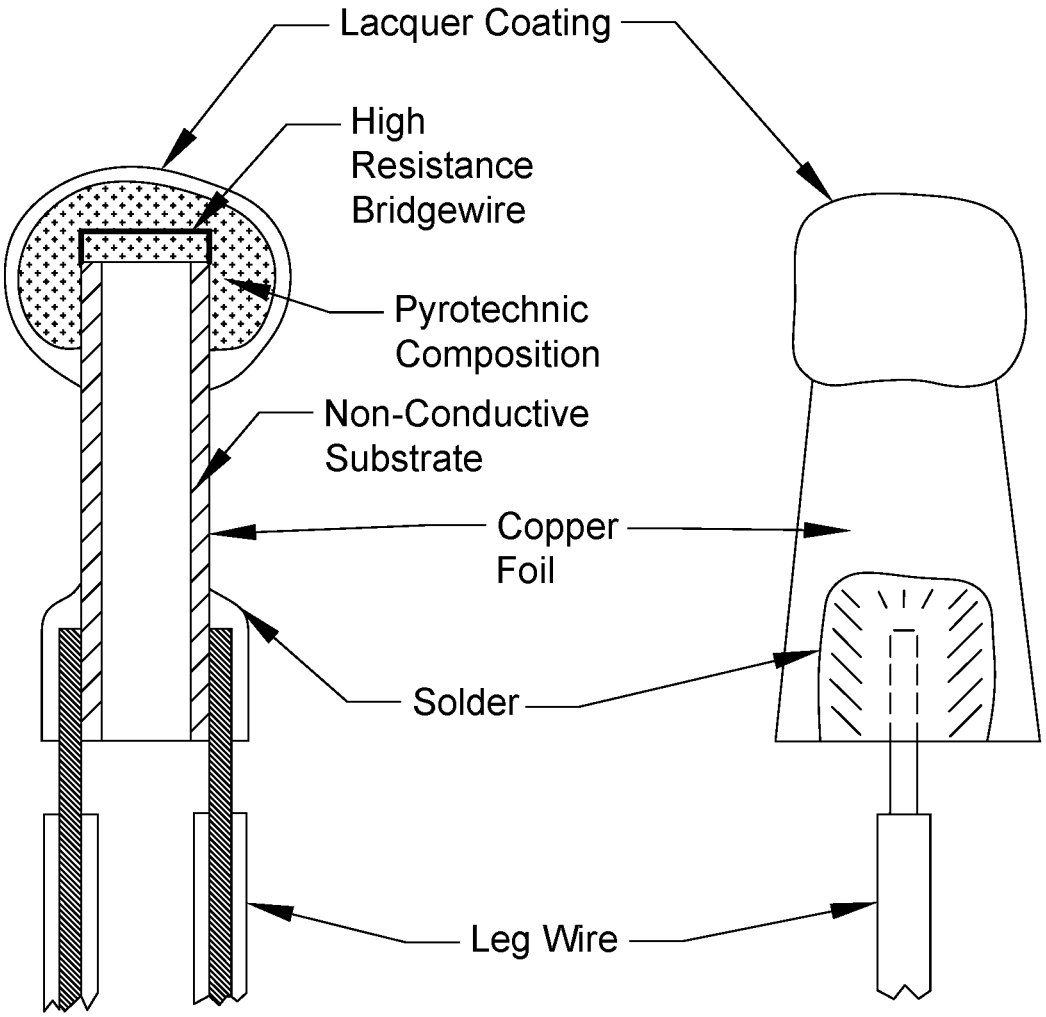
FIG. 8 (Prior Art)
FIG. 8 is a prior art electric match ignition source which can be used in the smoke device of the present invention.
Figure 9:
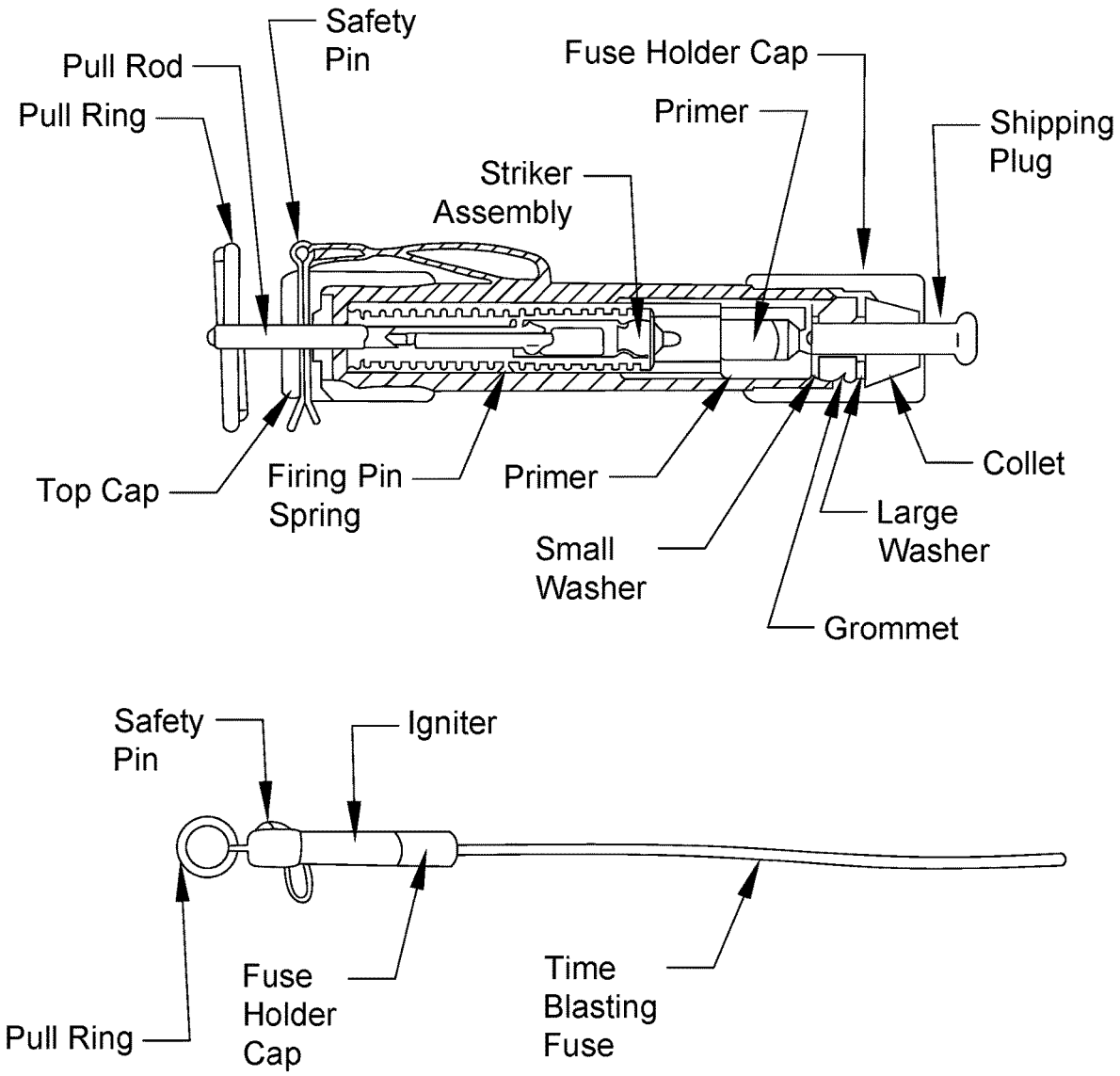
FIG. 9 (Prior Art)
FIG. 9 is a prior art pull pin/percussion ignition source which can be used in the smoke device of the present invention.
Figure 10:
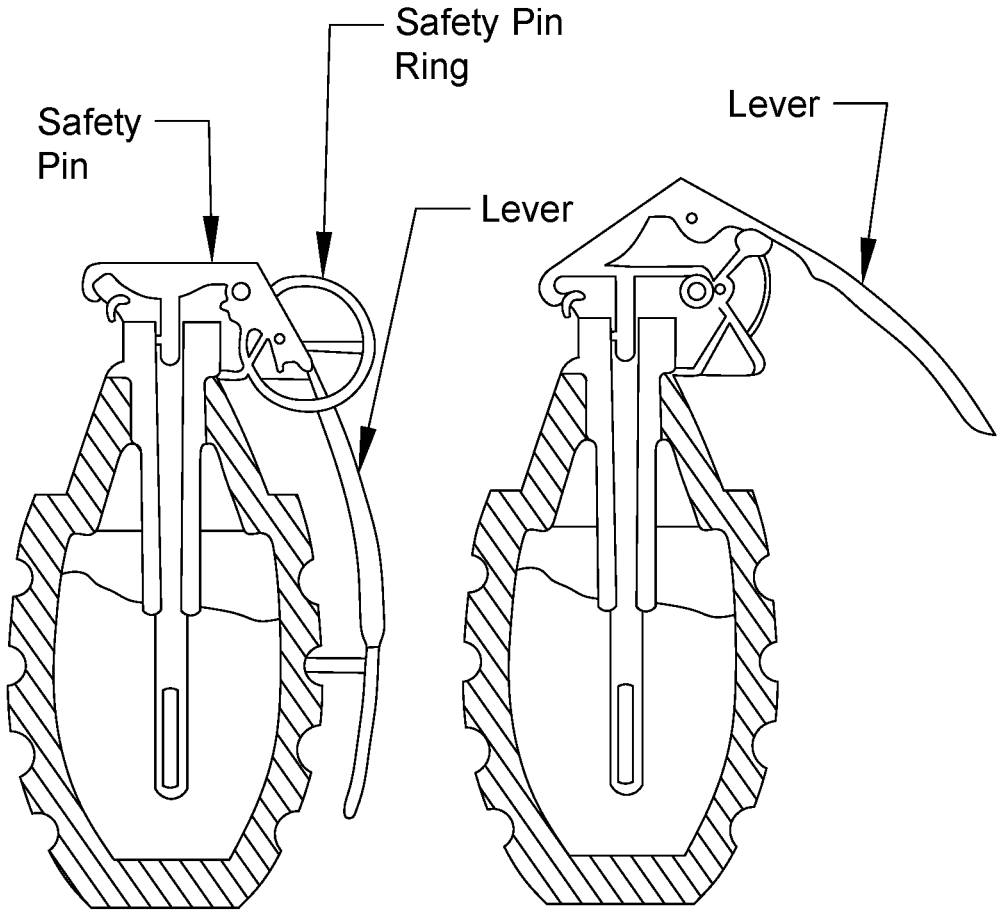
FIG. 10 (Prior Art)
FIG. 10 is a fly-off lever ignition source which can be used in the smoke device of the present invention.

The technical solutions of the present disclosure will be clearly and completely described below with reference to the drawings. The embodiments described are only some of the embodiments of the present disclosure, rather than all of the embodiments. All other embodiments that are obtained by a person of ordinary skill in the art on the basis of the embodiments of the present disclosure without an inventive effort shall be covered by the protective scope of the present disclosure.

In the description of the present disclosure, it is to be noted that the orientational or positional relation denoted by the terms such as "center", "upper", "lower", "left", "right", "vertical", "horizontal", "inner" and "outer" is based on the orientation or position relationship indicated by the figures, which only serves to facilitate describing the present disclosure and simplify the description, rather than indicating or suggesting that the device or element referred to must have a particular orientation, or is constructed or operated in a particular orientation, and therefore cannot be construed as a limitation on the present disclosure. In addition, the terms "first", "second" and "third" merely serve the purpose of description and should not be understood as an indication or implication of relative importance.

In the description of the present disclosure, it should be noted that unless otherwise explicitly specified and defined, the terms "install", "link" and "connect" shall be understood in the broadest sense, which may, for example, refer to fixed connection, detachable connection or integral connection; may refer to mechanical connection or electrical connection; may refer to direct connection or indirect connection by means of an intermediate medium; and may refer to communication between two elements. A person of ordinary skill in the art would understand the specific meaning of the terms in the present disclosure according to the specific situations.

In the prior art devices of FIG. 1, FIG. 2, FIG. 3, FIG. 4 and FIG. 5 the blend of chemicals is installed within the container. The container has a single exit point or two exit ports for the smoke to vent through. More than two exit holes is also known. The exit point(s) is/are usually a small aperture which enables the smoke to build in pressure and exit the container at a higher pressure and with greater projection. The container is formed of only a single space between the bottom of the container and the exit hole.

Furthermore, in the prior art, there are a variety of ignition methods such as a safety fuse (i.e. lit from an external source), an electric igniter/electric match, friction or strike (i.e. like a match) and pull pin/percussion or fly-off lever (i.e. mainly military) as shown in FIGS. 6-10. The fly-off lever is a particular type of percussion ignition and can only activate when it leaves the users hand, or the lever is released. When the lever is ejected, a striker is released and impacts a primer which is an impact sensitive pyrotechnic formula.

FIGS. 6-10 are known ignition apparatus and devices which can be used as the ignition apparatus and devices that ignites the present inventions' blend of chemicals within the present inventions' container of the present inventions smoke device.

The present disclosure of a smoke device is described in detail below in reference to the figures.

FIGS. 11-20 illustrate the present invention.

The present disclosure is a smoke device which has the ability to release different colors of smoke therefrom in a safe manner.

Figure 11:
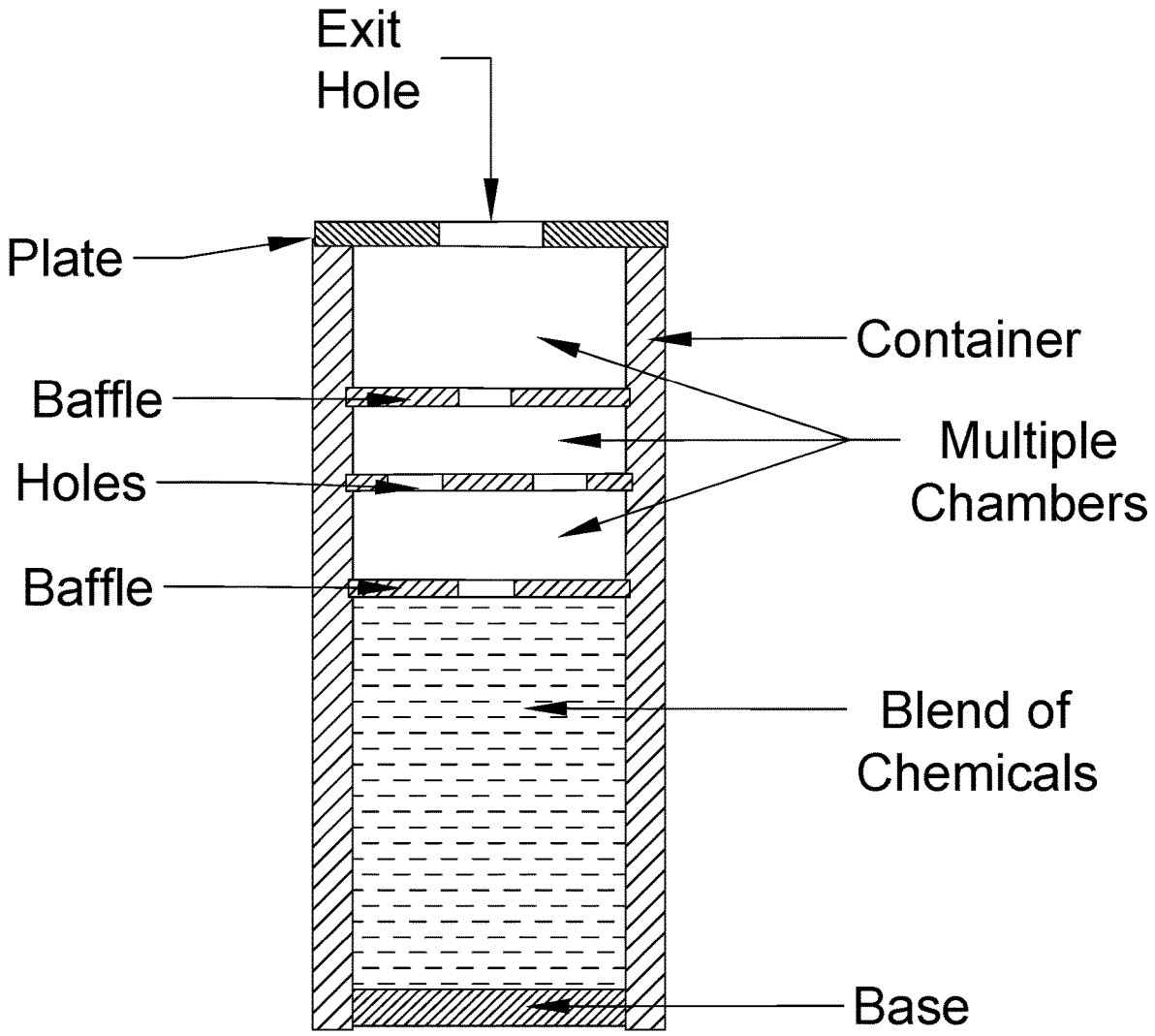
FIG. 11 is a front cross-sectional view of a smoke device of the present invention.
Figure 12:
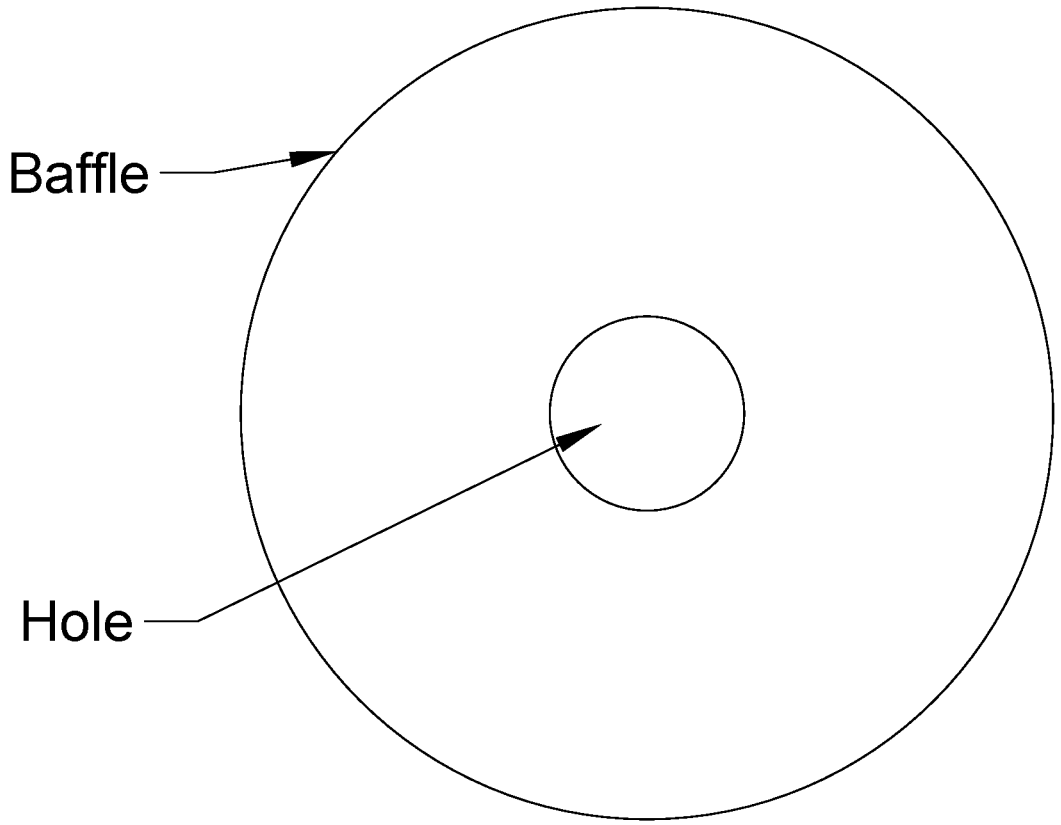
FIG. 12 is a top view of a baffle having a hole therein.
Figure 13:
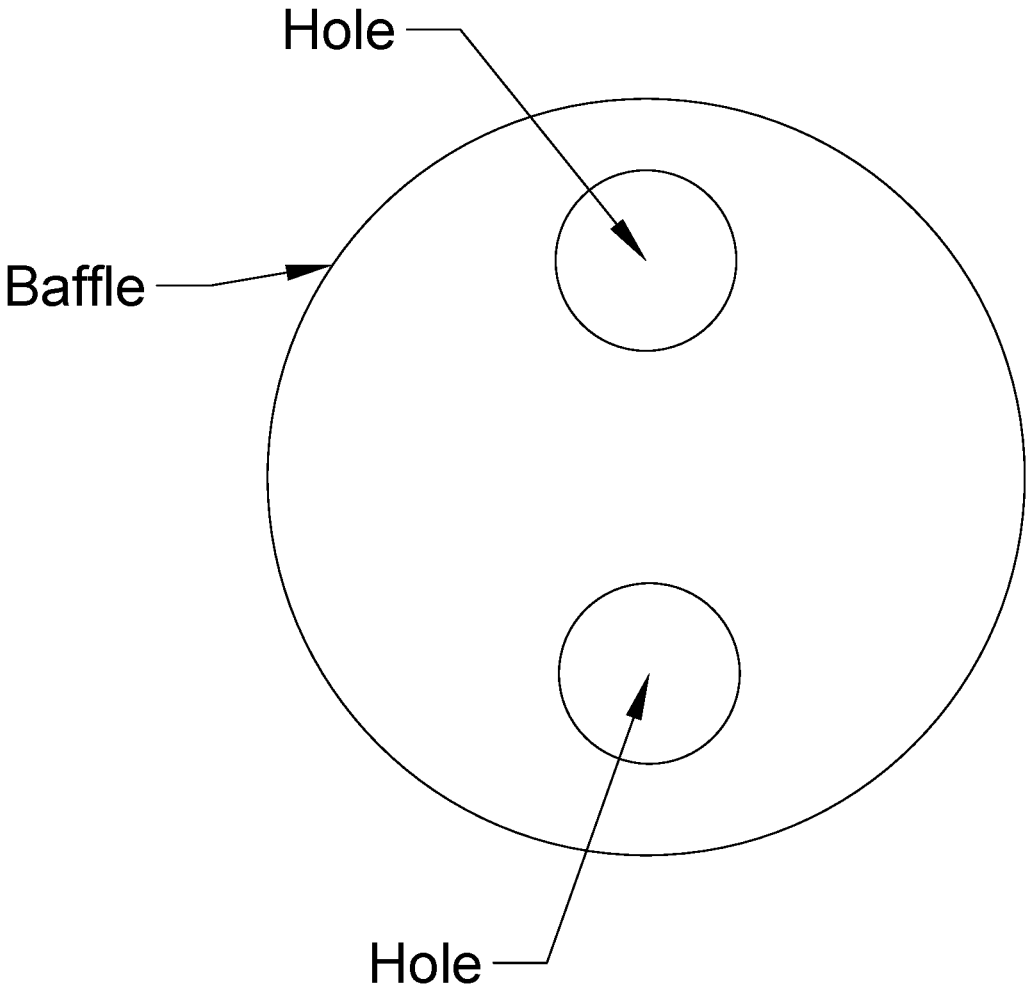
FIG. 13 is a top view of a baffle having two holes therein.
Figure 14:
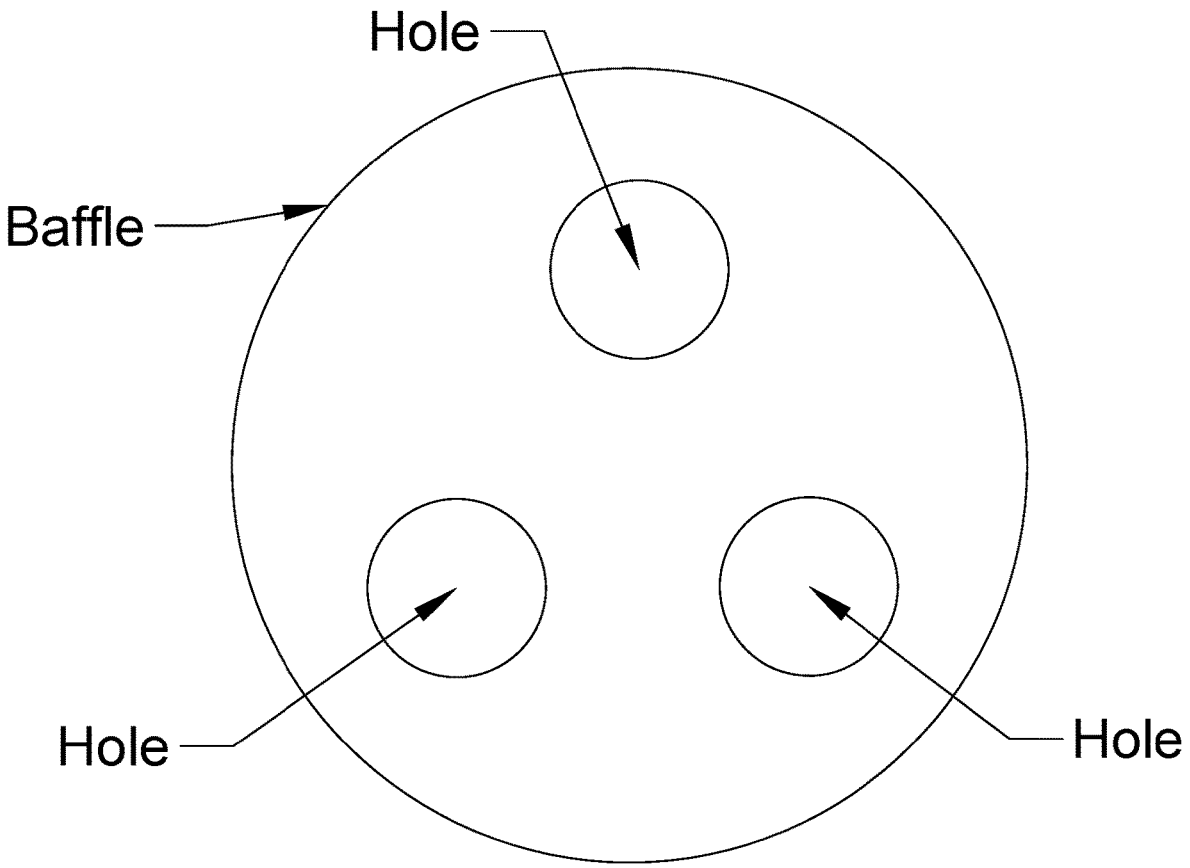
FIG. 14 is a top view of a baffle having three holes therein.
Figure 15:
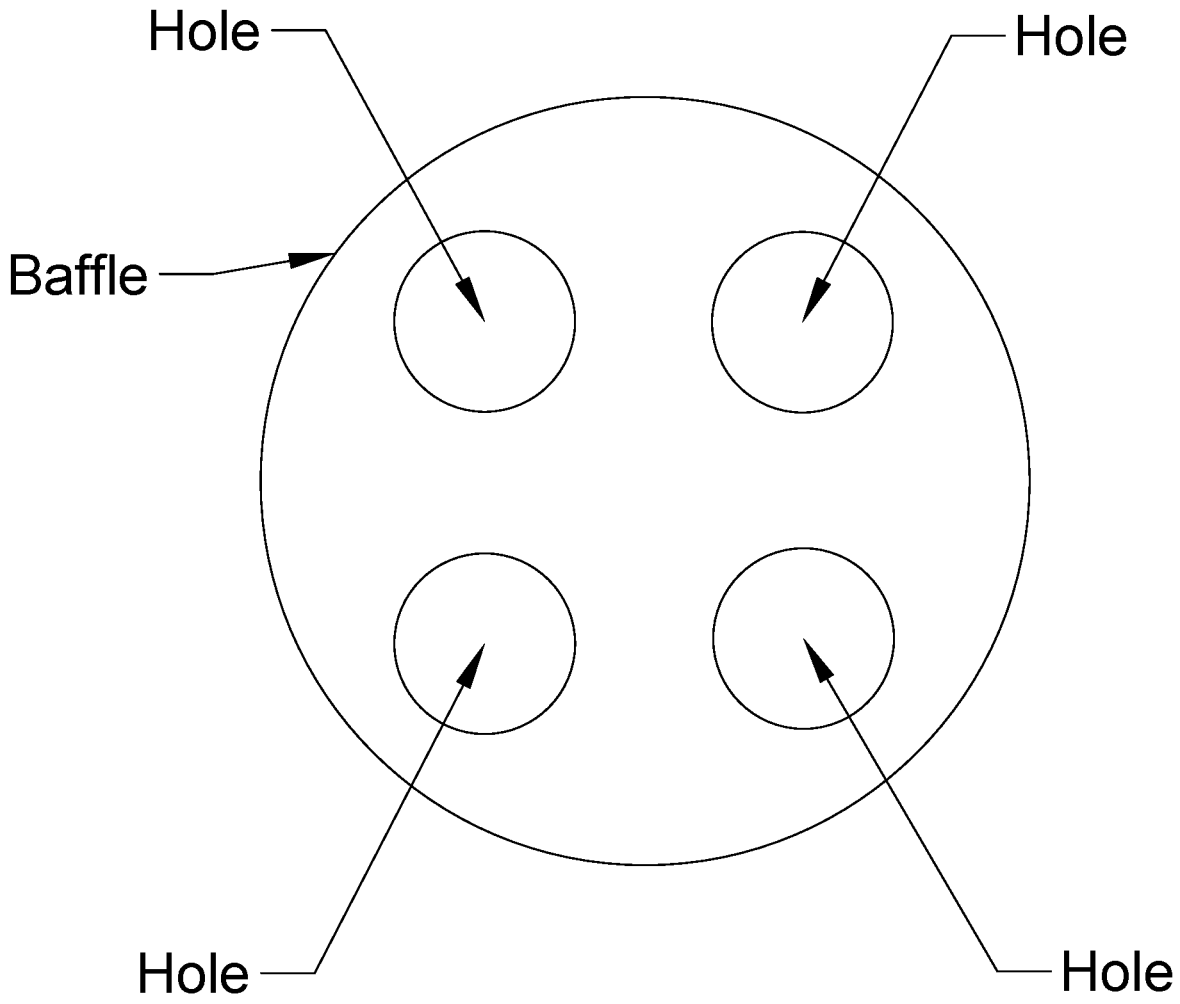
FIG. 15 is a top view of a baffle having four holes therein.

As shown in FIG. 11, the smoke device includes a container, a base/base plate, a plate having at least one exit hole, a blend of chemicals contained in the container and a mechanical means by which generated smoke is prevented from directly exiting through the at least one exit hole without first being redirected in one or more directions. The plate acts to reduce the diameter of the container at the at least one exit hole. This can be done in a variety of methods and with a variety of materials. The at least one exit hole in the plate can be called a choke. Thus, the container is said to be choked. The design and/or shape and the materials for the plates, plugs or plug style chokes can be different in the same device. One example of the blend of chemicals in the container is Potassium Nitrate (an oxidizer), Sulphur (a fuel), Colored Smoke Dye and Lactose. Another example of the blend of chemicals in the container is Potassium Chlorate, Lactose and Colored Smoke Dye. The container may be made from paper, cardboard, metal, alloy, composite materials, clay type materials or plastics.

The mechanical means by which generated smoke is prevented from directly exiting through the at least one exit hole without first being redirected in one or more directions may include a plurality of baffles which have at least one hole therein and a plurality of chambers formed by the plurality of baffles.

As shown in FIG. 11, the container may be made from cardboard, plastic, metal, alloy or a composite material.

Figure 19:
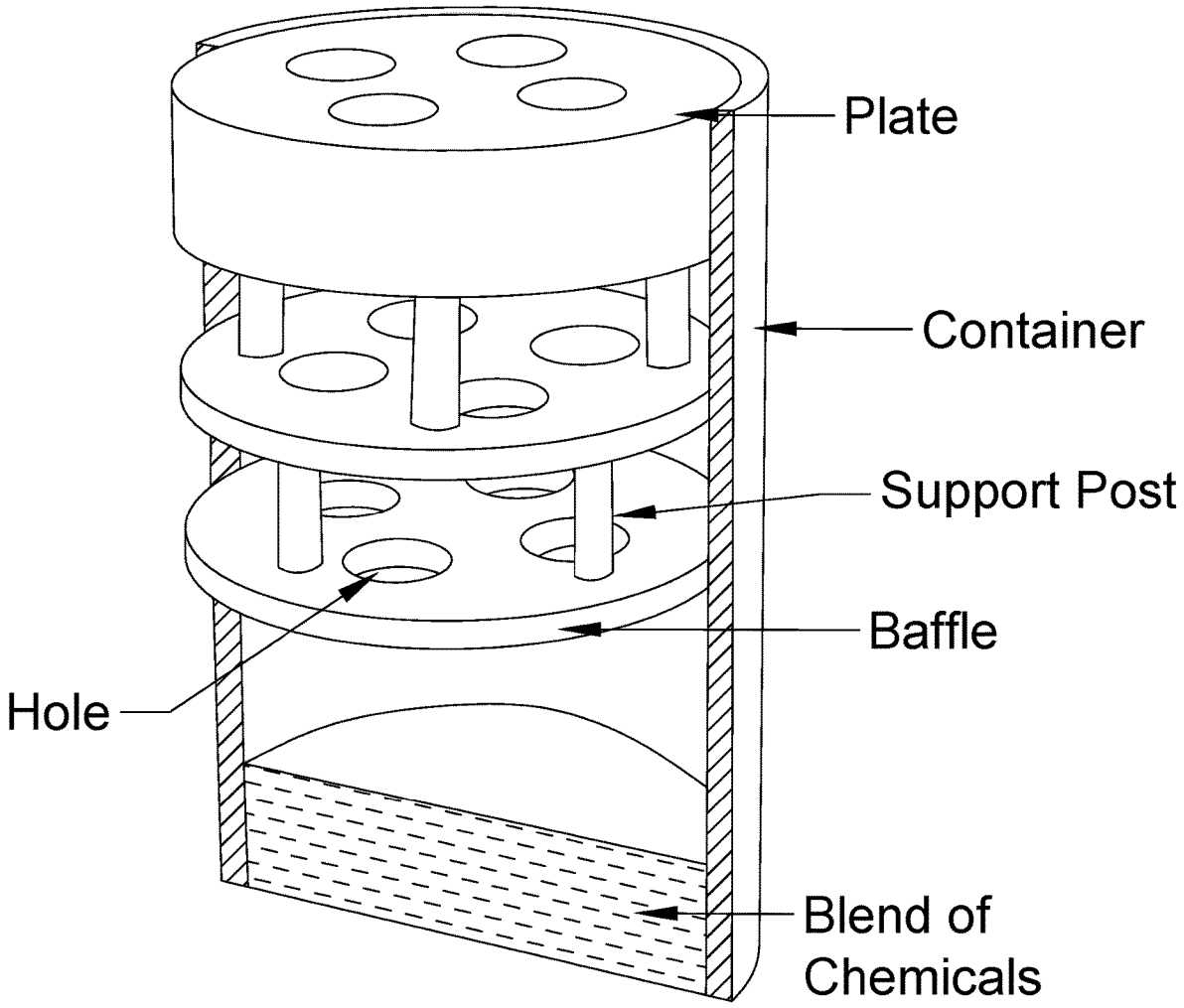
FIG. 19 is a cross-sectional view illustrating posts connecting the baffles and the top baffle connected to the plate/plug/choke within the smoke device.
Figure 20:
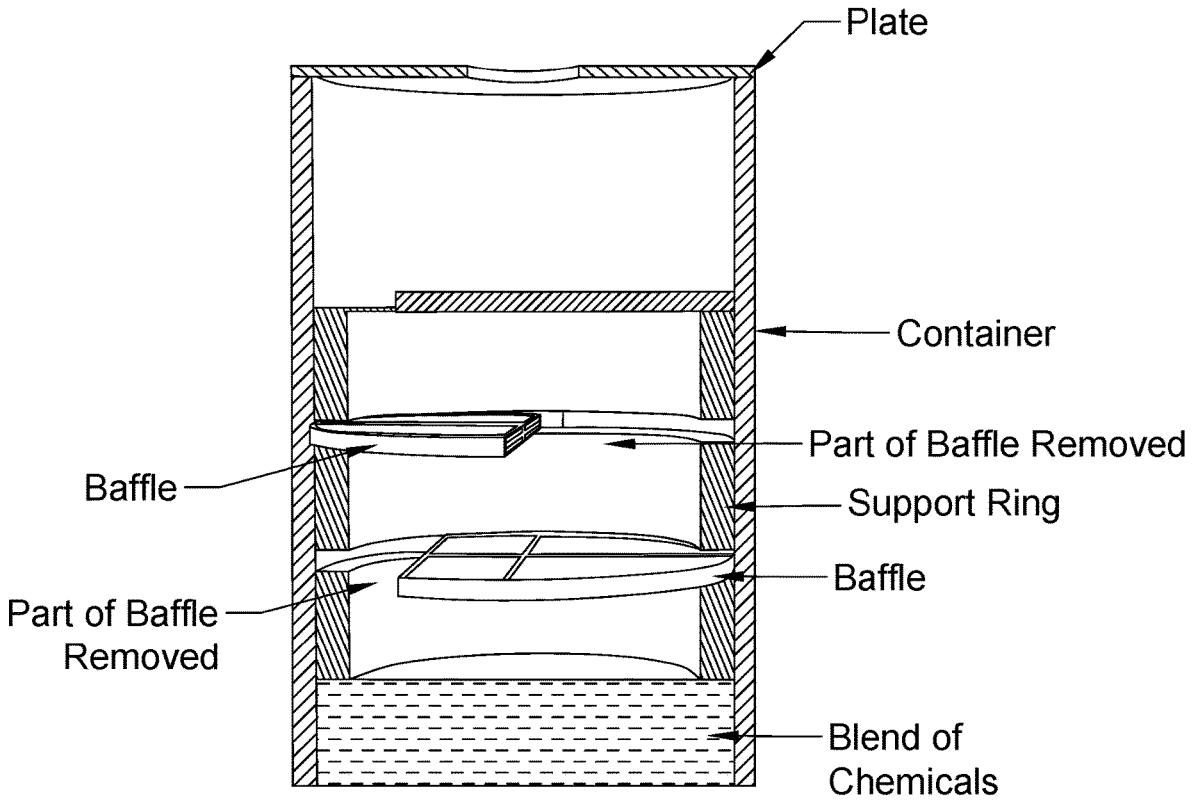
FIG. 20 is a cross-sectional view illustrating baffles having a part or parts of the baffle removed and wherein subsequent baffles are rotated within the smoke device.

As shown in FIG. 11, the base/base plate is located in the bottom of the container. The base/base plate seals the bottom of the contain such that the blend of chemicals contained in the container does not leak out of the container. The sealing of the base/base plate to the container may be by means of a glue, a sealant, an epoxy, a groove and O-ring seal, a friction fit seal or any equivalent sealing apparatus or by welding, soldering, riveting, securing screws through holes formed in the container and the base/base plate or other equivalent attachment methods. The base/base plate may be made from cardboard, clay, plastic, metal, alloy or a composite material. The base/base plate may be formed from a single part/piece or from multiple parts/pieces. As shown in FIG. 19, the baffles may be spaced apart by using support posts and the top most baffle in the smoke device may be attached to the plate. As shown in FIG. 20, the baffles have a part or parts of the baffle removed and wherein subsequent baffles are rotated within the smoke device such that the removed parts of the baffles are located/rotated differently from each adjacent baffle. For example, the removed part in each adjacent baffle does not line up in the vertical direction so that the smoke within the container cannot flow in a straight up vertical direction but rather has to flow up through the removed part of a baffle then flow at least in a non-straight vertical direction and then through the removed part of an adjacent baffle so as to form a meandering/zig-zap type of flow through the baffles within the container of the smoke device.

It is noted that the use of the baffles or similar physical barrier within the container of the smoke device to prevent or significantly reduce the sparks, flame and ash produced from the burning smoke composition from exiting the smoke device. This is done by causing a gas jet that is produced to change direction within the smoke device before exiting through the plate, plug or plug style choke. This can be accomplished by physically with baffle plates with holes, a spiral baffle and also part(s) of the baffle material removed. The different methods suit different manufacturing technics depending on the size of the smoke device and costs.

As shown in FIG. 11, the plate having at least one exit hole therein is attached to a top of the container. The plate is attached to the top of the container by using a glue, a sealant, an epoxy, a groove and O-ring seal, a friction fit seal or equivalent attachment apparatus or by welding, soldering, riveting, securing screws through holes formed in the container and the plate or other equivalent attachment methods. The at least one exit hole in the plate may be formed in the geometric center of the plate or may be off set from the geometric center of the plate. Moreover, there may be a plurality of holes in the plate. The holes may be circular, square or any other geometric or polygonal shape. The range of the hole sizes is dependent on the size (diameter) of the smoke device and the holes range between 5 mm-20 mm but maybe smaller or bigger depending on the size of the smoke device. The plate, plug and plug style choke may be made from cardboard, plastic, plate, clay type materials, metal, alloy or a composite material.

As shown in FIG. 11, the container of the smoke device has a plurality of chambers, a minimum of two chambers. The plurality of chambers is formed by the plurality of baffles. The distance between adjacent chambers may be the same for all chambers or there may be difference distances between adjacent chambers.

Figure 16:
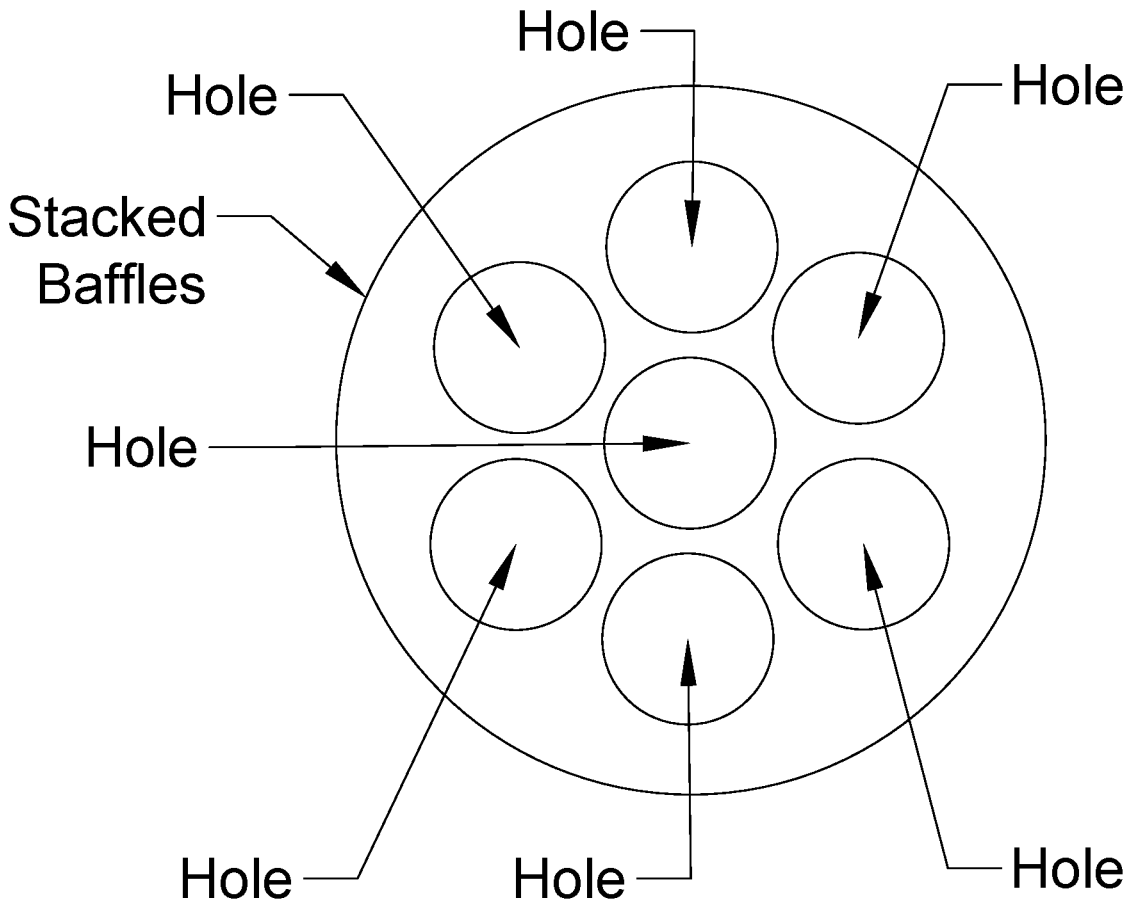
FIG. 16 is a top view of stacked baffles with offset holes.
Figure 17:
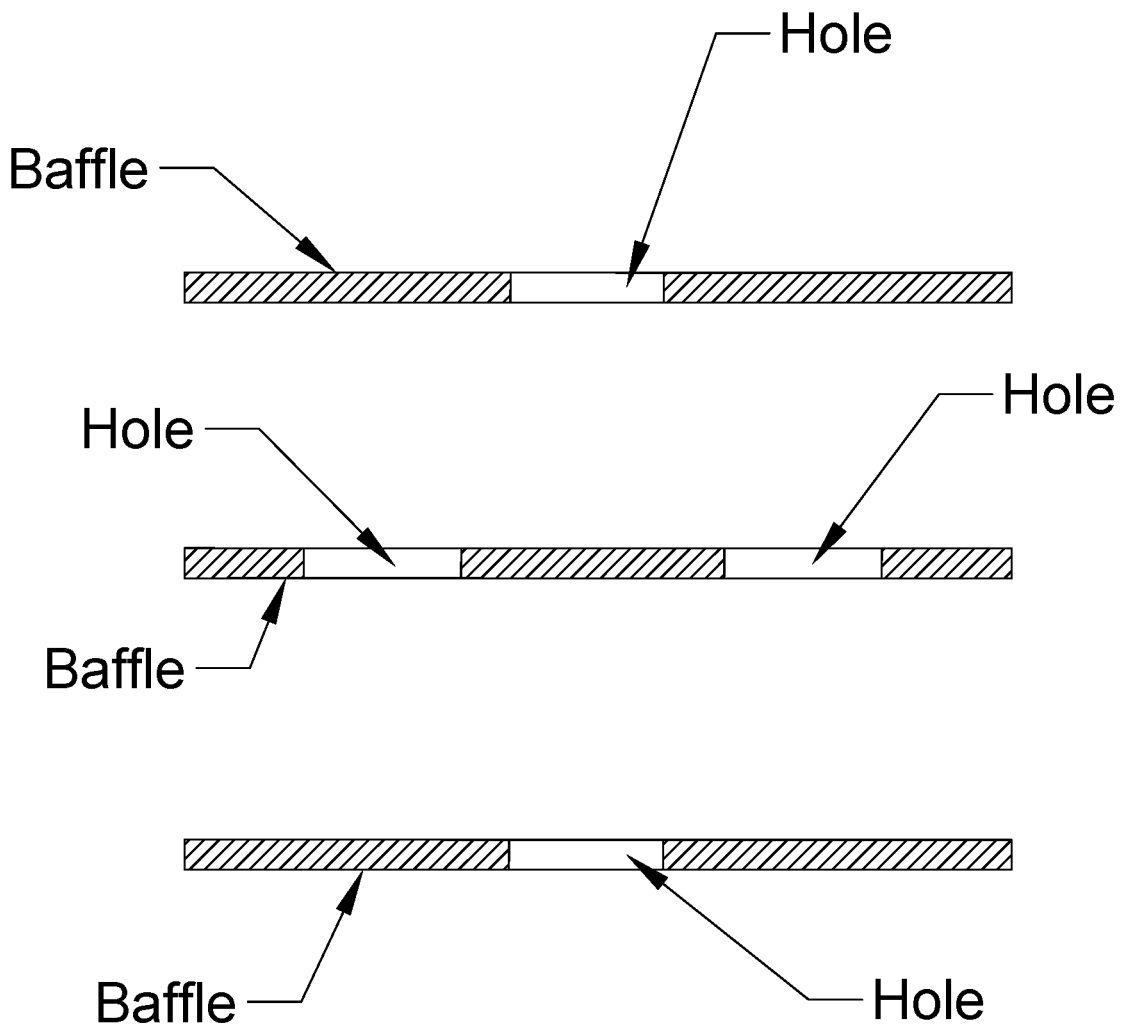
FIG. 17 is cross-sectional view of a stacking of the baffles with offset holes.
Figure 18:
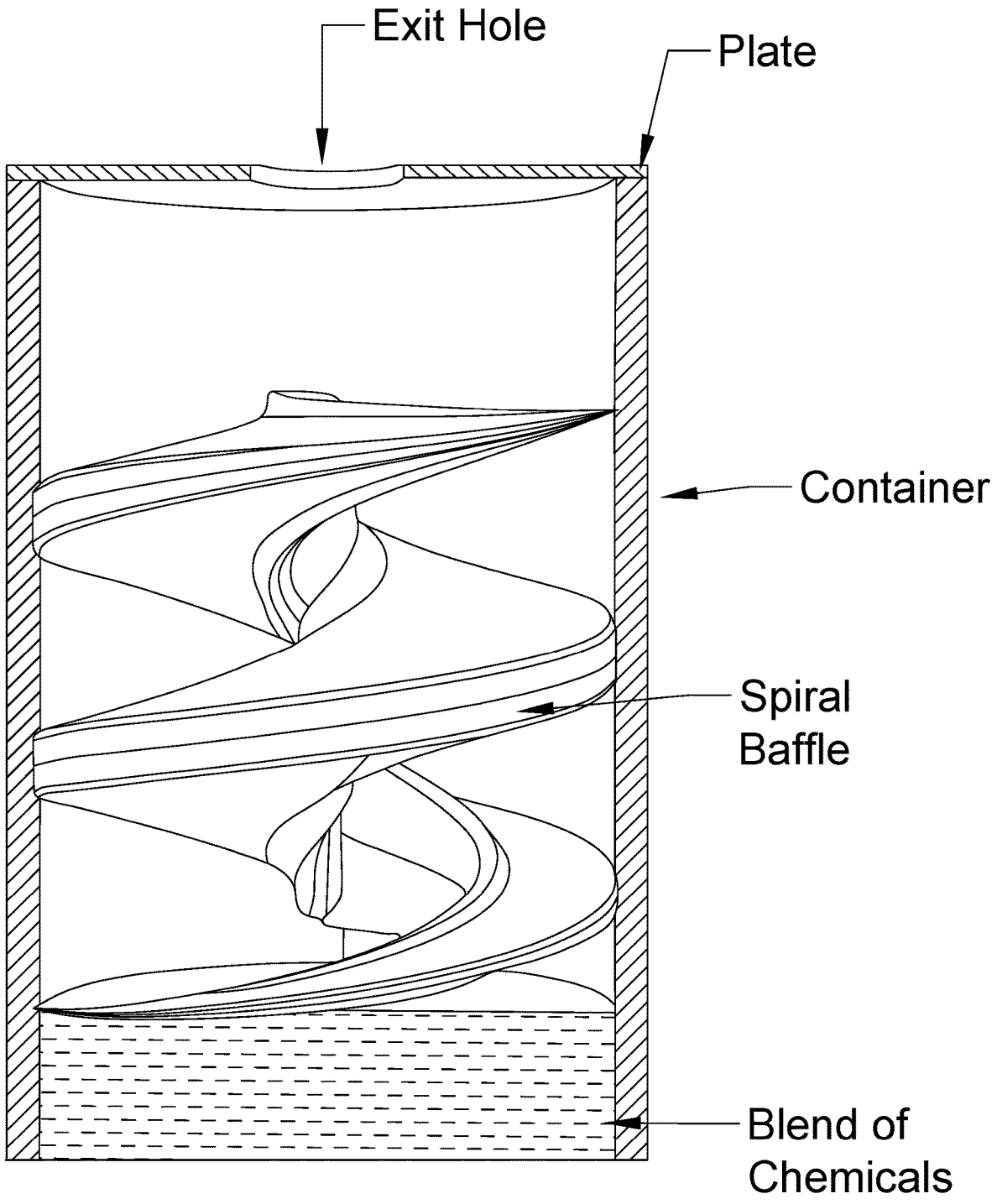
FIG. 18 is a cross-sectional view illustrating a spiral baffle within the smoke device.

As shown in FIGS. 12-17, each of the baffles has one or more holes therein. The range of the hole sizes in the baffles is dependent on the size (diameter) of the smoke device and the holes in the baffles range between 5 mm-20 mm but maybe smaller or bigger depending on the size of the smoke device. As shown in FIG. 16 and in FIG. 17, the plurality of baffles is placed in a staggered formation such that the hole(s) formed in each baffle is offset from the hole(s) in an adjacent/neighboring baffle. The hole(s) in each of the baffles are offset with regards to each neighboring baffle. The hole(s) in each baffle may be circular, square or any other geometric or polygonal shape. The hole(s) in each baffle may be formed in the geometric center of the baffle or may be off set from the geometric center of the baffle. Moreover, the holes in each baffle and/or each adjacent/neighboring baffle may have a different size or a same size in order to solve the problem of reducing sparks, hot ash and flames from exiting the smoke device, which prevents fire and injury and also cools the generated smoke thereby providing improved smoke color and less bleaching resulting in richer colors. The plurality of baffles and the plurality of chambers having offset holes serve to dramatically reduce and in some cases eliminate the hot ash, sparks and flame being emitted from the exit hole(s) and significantly reduces the chance of causing fires or injury to people. Thus, the disclosed smoke device is far safer than the existing prior art designs. Also, as shown in FIG. 18, the plurality of baffles may include one or more spiral baffle(s) in which the smoke moves up a spiral shaped tube or chute to an exit point of the spiral baffle. Each of the baffles may be made from cardboard, paper, plastic, metal, alloy or a composite material. Furthermore, each of the baffles may be made from a different material or some baffles may be made from the same material while other baffles are made from a different material in order to increase the cooling of the smoke and improve the smoke color and less bleaching resulting in richer colors. For example, the two lower most baffles in the container are made from metal or alloy and the upper most baffle in the container is made from plastic or a composite material. Another example made include the upper most baffle may be made from a metal or alloy, the bottom most baffle may be made from plastic or a composite material and one or two additional baffles are made from cardboard. The above disclosed examples are only a few specific disclosed examples but different examples of different baffles comprised of different materials which solve the problem of reducing sparks, hot ash and flames from exiting the smoke device, prevents fire and injury and also cooling the generated smoke and improving the smoke color and less bleaching resulting in richer colors are also part of the disclosure of this smoking device. Each of the baffles may be formed from a single part/piece or from multiple parts/pieces. Each of the baffles are attached or secured to an inner surface of the container by using a glue, a sealant, an epoxy, a groove and O-ring seal, a friction fit seal or equivalent attachment apparatus or by welding, soldering, riveting, securing screws through holes formed in the container and the baffles or other equivalent attachment methods. Moreover, each of the baffles are position above the top level of the blend of chemicals which is contained in the container as shown in FIG. 11.

As shown in FIG. 21, FIG. 22, FIG. 23 and FIG. 24, the smoke device may also include support posts and/or support rings and/or support pins and/or support brackets.

The container of the smoke device has a plurality of chambers, a minimum of two chambers. The plurality of chambers is formed by the plurality of baffles. The distance between adjacent chambers may be the same for all chambers or there may be difference distances between adjacent chambers. The plurality of baffles may be spaced apart by using support posts and/or the plurality of baffles can be supported/held in place using support ring(s) and/or the plurality of baffles can be supported/held in place using support pin(s) and/or the plurality of baffles can be supported/held in place by support bracket(s) and the top most baffle in the smoke device may be attached to the plate.

Figure 21:
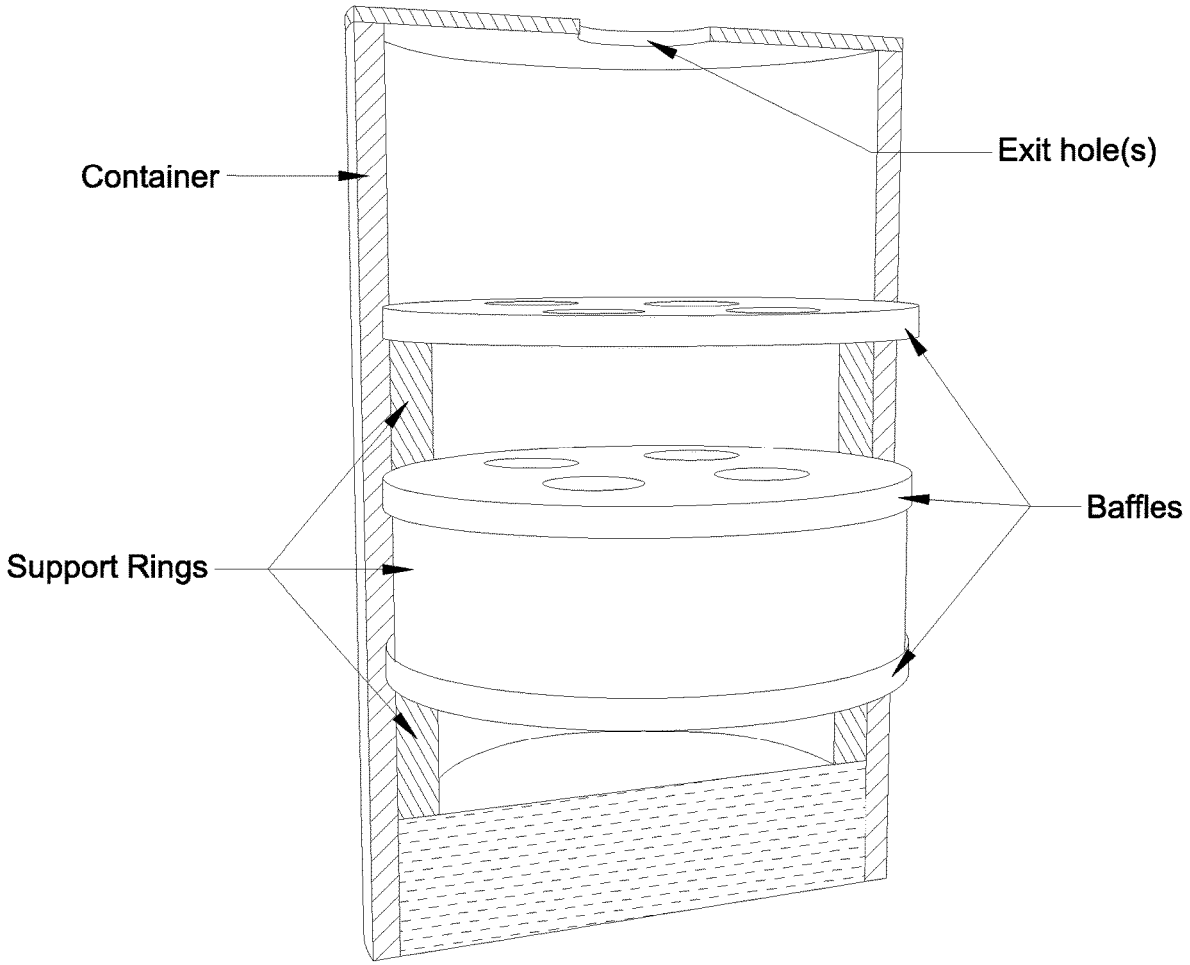
FIG. 21 is an interior view of the smoke device including baffles and support rings.
Figure 22:
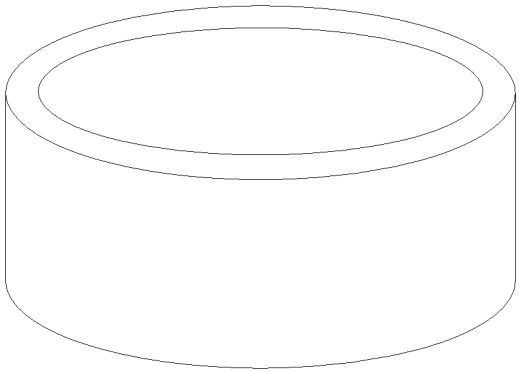
FIG. 22 is a perspective view of a support ring.

As shown in FIG. 21 and FIG. 22, the support ring has an outside wall that is the shape of the inside wall of the container. The support ring has a height and a wall thickness resulting in the support ring being hollow (i.e. the support ring has a hollow interior). The support ring makes contact with surfaces of the baffles. For example, a top surface of one baffle makes contact with a bottom surface of the support ring and a top surface of the support ring makes contact with a bottom surface of an adjacent baffle. The support ring can be made of a variety of materials such as cardboard, metal plastic, wood clay or composite material and may be made from the same or different material than the container and/or one or all baffles. The support ring may be attached to the container or the inside surface of the container or spaced a distance from the inner surface of the container such there is a gap between the inside surface of the container and the support ring. Moreover, at least one support ring may be attached to the inner surface of the container and one or more other support rings are spaced a distance from the inner surface of the container such there is a gap between the inside surface of the container and the support ring.

The support ring may or may not be glued, pinned, stapled or riveted or equivalent fastening apparatus or elements to the inside all of the container and may or may not be glued to the baffles.

Figure 23:
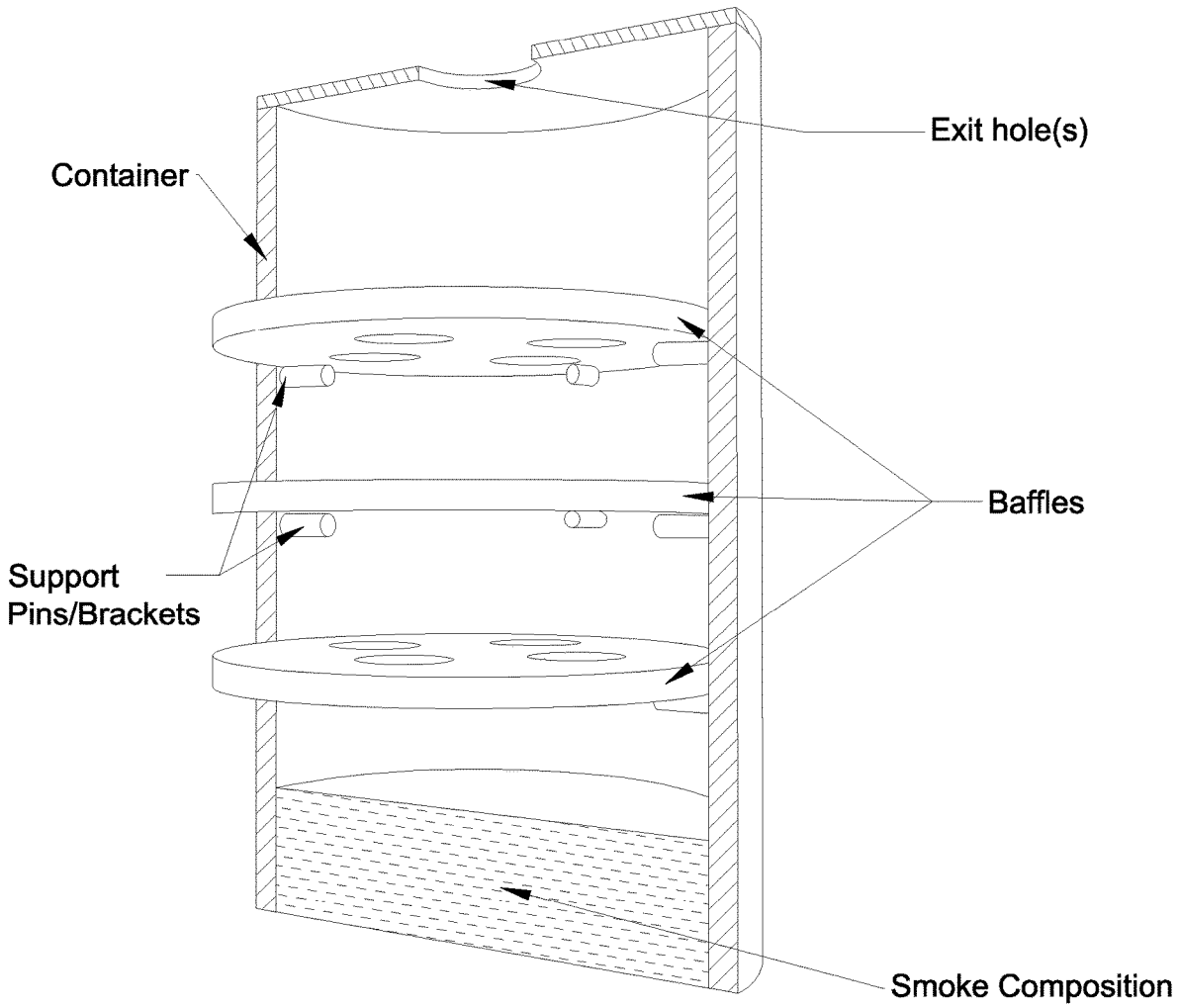
FIG. 23 is an interior view of the smoke device including baffles and support pins and brackets.

As shown in FIG. 23, support pin(s) has/have a 1-5 mm in diameter and 5-30 mm in length of a material that protrudes into or is stuck to the wall of the container. The support pin(s) can be made from a variety of materials such as cardboard, metal plastic, wood, clay or composite material and may be made from the same or different material than the container and/or one or all baffles. The support pin(s) may or may not be glued to the baffles or may or may not be inserted into the baffle to hold or in position. The support pin(s) may be circular, square or any other geometric or polygonal shape.

Figure 24:
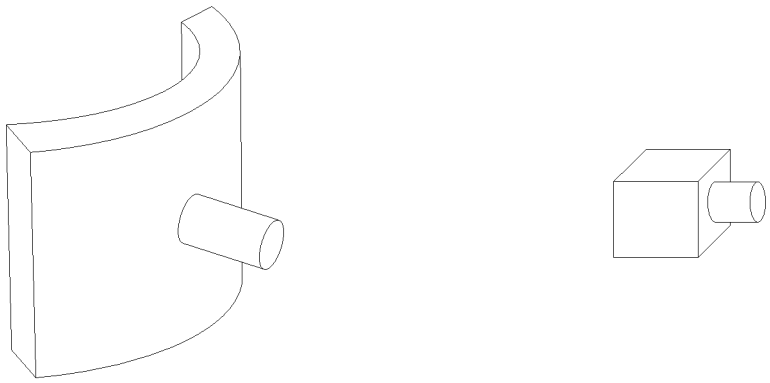
FIG. 24 is a perspective view of support brackets.

As shown in FIG. 24, the support bracket(s) can be a variety of shapes and sizes such as circular, square or any other geometric or polygonal shape, and including part of the support ring that is either glued to the inside wall of the container or has a protrusion that protrudes into the wall of the container. The baffles may or may not be glued to the support bracket.

The smoke device and design incorporating the plurality of baffles and multiple chambers may function with and by all existing ignition devices and methods such as a safety fuse, an electric igniter/electric match, friction or strike (i.e. like a match) and percussion or fly-off lever. Thus, the blend of chemicals contained in the container may be heated with any of the above ignition devices and methods to generate the smoke or colored smoke. The range of distances between each of the baffles is dependent on the size (length and diameter) of the smoke device and the distance between each of the baffles can range between 10 mm and 100 mm but could be smaller or bigger depending on the size of the smoke device. The types of ignition come from the ways in which heat can be generated such as heat from an external source, friction, electrical and impact (percussion). Within these general groups the actual mechanism of generating the heat can vary widely and many involve more than one type connected together known as a pyrotechnic train.

The device is mainly for civilian use but may also be applied to military and law enforcement training devices. The smoke device is not a military specific product. The smoke device reduces and/or eliminates sparks, hot ash and flames from exiting the smoke device and thus is safer than existing prior art products. Therefore, the smoke device is safer to use because the smoke device vastly reduces sparks, hot ash and flames from exiting the smoke device, prevents fire and injury and the generated smoke passing through the baffles and/or chambers cools more than other prior art devices with a single chamber or no chamber. Thus, this cooler generated smoke gives an improved color and less bleaching resulting in richer colors.

What is claimed is:

1. A smoke device comprising
a container,
a base adapted to the container,
a plate having at least one exit hole and attached to the container,
a blend of chemicals contained in the container,
at least one support ring,
positioned inside the container is a mechanical means by which generated smoke is prevented from directly exiting through the at least one exit hole without first being redirected in one or more directions,
wherein the mechanical means comprises a plurality of baffles and a plurality of chambers formed by the plurality of baffles; wherein each of the plurality of baffles has at least one hole therein,
wherein some of the plurality of baffles are made from a same material and other baffles of the plurality of baffles are made from a different material, where the different material is not the same as the same material in order to increase cooling of generated smoke,
wherein the same material is a metal or an alloy and the different material is cardboard, clay, or plastic, and
the support ring comprises a plurality of support rings, wherein each support ring is attached to the container and makes contact with two of the plurality of baffles.

2. The smoke device according to claim 1, wherein the plate has a plurality of exit holes.

3. The smoke device according to claim 1, wherein the at least one exit hole is one exit hole.

4. The smoke device according to claim 1, wherein the plurality of baffles is placed in a staggered formation such that the at least one hole formed in each adjacent baffle of the plurality of baffles is offset.

5. The smoke device according to claim 1, wherein the plurality of baffles is made from cardboard, clay, plastic, metal, alloy or a composite material.

6. The smoke device according to claim 1, wherein the plurality of baffles is attached to an inner surface of the container.

7. The smoke device according to claim 1, wherein each of the plurality of baffles is positioned above a level of the blend of chemicals contained in the container.

8. The smoke device according to claim 1, wherein the at least one hole in each of the plurality of baffles reduces sparks, hot ash and flames from exiting the smoke device.

9. The smoke device according to claim 1, wherein the at least one hole in each of the plurality of baffles has a different size.

10. The smoke device according to claim 1, wherein the plate is attached to a top of the container.

11. The smoke device according to claim 1, wherein the at least one exit hole is circular is shape.

12. The smoke device according to claim 1, wherein the plate is made from cardboard, clay, plastic, metal, alloy or a composite material.

13. The smoke device according to claim 1, wherein the at least one hole in each of the plurality of baffles is circular in shape.

14. The smoke device according to claim 1, wherein the support ring has a hollow interior.

15. The smoke device according to claim 1, wherein the at least one exit hole is located in a geometric center of the plate.

16. The smoke device according to claim 1, wherein a distance between adjacent chambers of the plurality of chambers is different.

* * * * *